US005536615A

United States Patent [19]

Hopper et al.

[11] Patent Number: 5,536,615

[45] Date of Patent: Jul. 16, 1996

[54] LIQUID DEVELOPERS AND TONER AGGREGATION PROCESSES

[75] Inventors: Michael A. Hopper, Toronto; Raj D. Patel, Oakville; Grazyna E. Kmiecik-Lawrynowicz, Burlington; Peter G. Odell, Mississauga, all of Canada; Bernard Grushkin, Pittsford; George A. Gibson, Fairport, both of N.Y.

[73] Assignee: Xerox Corporation, Stamford, Conn.

[21] Appl. No.: 498,206

[22] Filed: Jul. 5, 1995

[51] Int. Cl.[6] ..... G03G 9/13; G03G 9/135

[52] U.S. Cl. ..... 430/137; 430/115

[58] Field of Search ..... 430/115, 137

[56] References Cited

U.S. PATENT DOCUMENTS

| | | | |
|---|---|---|---|
| 4,707,429 | 11/1987 | Trout | 430/115 |
| 4,996,127 | 2/1991 | Hasegawa et al. | 430/109 |
| 5,030,535 | 7/1991 | Drappel et al. | 430/116 |
| 5,045,425 | 9/1991 | Swidler | 430/115 |
| 5,290,654 | 3/1994 | Sacripante et al. | 430/137 |
| 5,364,729 | 11/1994 | Kmiecik-Lawrynowicz | 430/137 |
| 5,370,963 | 12/1994 | Patel et al. | 430/137 |
| 5,370,964 | 12/1994 | Patel et al. | 430/137 |
| 5,403,693 | 4/1995 | Patel et al. | 430/137 |

*Primary Examiner*—Roland Martin
*Attorney, Agent, or Firm*—E. O. Palazzo

[57] ABSTRACT

A process for the preparation of liquid developers comprising:

(i) preparing a pigment dispersion, which dispersion is comprised of a pigment, and an ionic surfactant;

(ii) shearing said pigment dispersion with a latex or emulsion blend comprised of a nonionic surfactant, resin, and a counterionic surfactant with a charge polarity of opposite sign to that of said ionic surfactant and optionally adding further anionic, or nonionic surfactant to stabilize the aggregates obtained in (iii);

(iii) heating the above resulting sheared aqueous blend below about the glass transition temperature (Tg) of the resin to form toner size aggregates with a narrow particle size distribution;

(iv) heating said bound aggregates above about the Tg of the resin to form toner size particles in an aqueous medium and which particles possess a narrow particle size distribution; and (v) separating from the aqueous medium toner particles of resin and pigment, and dispersing said toner particles in a carrier fluid.

28 Claims, No Drawings

LIQUID DEVELOPERS AND TONER AGGREGATION PROCESSES

BACKGROUND OF THE INVENTION

The present invention is generally directed to toner processes, and more specifically, to aggregation and coalescence processes for the preparation of toner compositions. In embodiments, the present invention is directed to the economical chemical in situ preparation of liquid toners without the utilization of the known pulverization and/or classification methods for the preparation of the solids component of toner resin and pigment, and wherein in embodiments toner compositions with an average volume diameter of from about 1 to about 10 and preferably from 1 to about 3 microns, and narrow GSD of, for example, from about 1.16 to about 1.26 as measured on the Coulter Counter can be obtained and are dispersed in a suitable liquid development carrier fluid, such as a mineral oil, and the like. The resulting liquid toners can be selected for known electrophotographic imaging, printing processes, including color processes, and lithography. In embodiments, the present invention is directed to a process comprised of dispersing a pigment, and optionally toner additives like a charge control agent or additive in an aqueous mixture containing an ionic surfactant in an amount of from about 0.5 percent (weight percent throughout unless otherwise indicated) to about 10 percent, and shearing this mixture with a latex or emulsion mixture comprised of suspended submicron resin particles of from, for example, about 0.01 micron to about 2 microns in volume average diameter in an aqueous solution containing a counterionic surfactant in amounts of from about 1 percent to about 10 percent with opposite charge to the ionic surfactant of the pigment dispersion, and nonionic surfactant in amounts of from about 0 percent to about 5 percent, thereby causing a flocculation of resin particles, pigment particles and optional charge control agent, followed by heating at about 5 to about 40° C. below the resin Tg and preferably about 5 to about 25° C. below the resin Tg while stirring of the flocculent mixture, which is believed to form statically bound aggregates of from about 1 micron to about 10 microns in volume average diameter comprised of resin, pigment and optionally charge control particles, and thereafter heating the formed bound aggregates about above the Tg (glass transition temperature) of the resin, and subsequently forming a liquid toner by for example dispersing the formed toner in a hydrocarbon fluid. The size of the aforementioned aggregated particles can be controlled by adjusting the temperature in the below the resin Tg heating stage. An increase in the temperature causes an increase in the size of the aggregated particle. This process of aggregating submicron latex and pigment particles is kinetically controlled, that is the temperature increases the process of aggregation. The higher the temperature during stirring the quicker the aggregates are formed, for example from about 2 to about 10 times faster in embodiments, and the latex submicron particles are picked up more quickly. The temperature also controls in embodiments the particle size distribution of the aggregates, for example the higher the temperature the narrower the particle size distribution, and this narrower distribution can be achieved in, for example, from about 0.5 to about 24 hours and preferably in about 1 to about 3 hours time. Heating the mixture about above or in embodiments equal to the resin Tg generates toner particles with, for example, an average particle volume diameter of from about 1 to about 25 and preferably 10 microns. It is believed that during the heating stage, the components of aggregated particles fuse together to form composite toner particles. In another embodiment thereof, the present invention is directed to an in situ process comprised of first dispersing a pigment, such as HELIOGEN BLUE™ or SUNSPERSE™ or FLEXVERSE™ BLUE, magenta, yellow, or black in an aqueous mixture containing a cationic surfactant, such as benzalkonium hloride (SANIZOL B-50™), utilizing a high shearing device, such as a Brinkmann Polytron, microfluidizer or sonicator, thereafter shearing this mixture with a latex of suspended resin particles, such as poly(styrene butadiene acrylic acid), poly(styrene butylacrylate acrylic acid) or PLIOTONE™, a poly(styrene butadiene), and which particles are, for example, of a size ranging from about 0.01 to about 0.5 micron in volume average diameter as measured by the Brookhaven nanosizer in an aqueous surfactant mixture containing an anionic surfactant, such as sodium dodecylbenzene sulfonate, for example NEQGEN R™ or NEOGEN SC™, and a nonionic surfactant such as alkyl phenoxy poly(ethylenoxy)ethanol, or example IGEPAL 897™ or ANTAROX 897™, thereby resulting in a flocculation, or heterocoagulation of the resin particles with the pigment particles; and which, on further stirring for about 0.5 to about 3 hours while heating, for example, from about 35 to about 45° C., results in the formation of statically bound aggregates ranging in size of from about 0.5 micron to about 10 microns in average diameter size as measured by the Coulter Counter (Microsizer II), where the size of those aggregated particles and their distribution can be controlled by the temperature of heating, for example from about 5 to about 25° C. below the resin Tg, and where the speed at which toner size aggregates are formed can also be controlled by the temperature. Thereafter, heating from about 5 to about 50° C. above the resin Tg provides for particle fusion or coalescence of the polymer and pigment particles; followed by optional washing with, for example, water to remove surfactant, and drying whereby toner particles comprised of resin and pigment with various particle size diameters can be obtained, such as from 1 to about 20, and preferably 12 microns in average volume particle diameter. The aforementioned toners are especially useful for the development of colored images with excellent line and solid resolution, and wherein substantially no background deposits are present.

Numerous processes are known for the preparation of dry toners, such as, for example, conventional processes wherein a resin is melt kneaded or extruded with a pigment, micronized and pulverized to provide toner particles with an average volume particle diameter of from about 9 microns to about 20 microns, and with broad geometric size distribution of from about 1.4 to about 1.7. In these processes, it is usually necessary to subject the aforementioned toners to a classification procedure such that the geometric size distribution of from about 1.2 to about 1.4 is attained. Also, in the aforementioned conventional process, low toner yields after classifications are obtained. Generally, during the preparation of toners with average particle size diameters of from about 11 microns to about 15 microns, toner yields range from about 70 percent to about 85 percent after classification. Additionally, during the preparation of smaller sized toners with particle sizes of from about 7 microns to about 11 microns, lower toner yields can be obtained after classification, such as from about 50 percent to about 70 percent. With the processes of the present invention in embodiments, small average particle sizes of, for example, from about 2 microns to about 9 microns, and preferably 3 microns, are attained without resorting to classification processes, and wherein narrow geometric size distributions are attained, such as from about 1.16 to about 1.30, and preferably from about 1.16 to about 1.25. High toner yields are also attained such as from about 90 percent to about 98 percent in embodiments of the present invention. In addition, by the toner particle preparation process of the present invention in embodiments, small particle size toners of from about 3 microns to about 7 microns can be economically prepared in high yields, such as from about 90 percent to about 98 percent by weight based on the weight of all the toner material ingredients, such as toner resin and pigment.

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. Also, see column 9, lines 50 to 55, wherein a polar monomer, such as acrylic acid, in the emulsion resin is necessary, and toner preparation is not obtained without the use, for example, of acrylic acid polar group, see Comparative Example I. In U.S. Pat. No. 4,983,488, there is disclosed a process for the preparation of toners by the polymerization of a polymerizable monomer dispersed by emulsification in the presence of a colorant and/or a magnetic powder to prepare a principal resin component, and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70 are obtained. This process is thus directed to the use of coagulants, such as inorganic magnesium sulfate, which results in the formation of particles with a wide GSD. Furthermore, the '488 patent does not, it appears, disclose the process of counterionic, for example controlled aggregation is obtained by changing the counterionic strength, flocculation. Similarly, the aforementioned disadvantages, for example poor GSD is obtained hence classification is required resulting in low toner yields, are illustrated in other prior art, such as U.S. Pat. No. 4,797,339, wherein there is disclosed a process for the preparation of toners by resin emulsion polymerization, wherein similar to the '127 patent certain polar resins are selected.

Certain liquid developers and processes thereof are known. A latent electrostatic image can be developed with toner particles comprised of solids of resin, pigment, and charge adjuvant dispersed in an insulating nonpolar liquid, and charge director. A latent electrostatic image may be generated by providing a photoconductive layer with a uniform electrostatic charge and subsequently discharging the electrostatic charge by exposing it to a modulated beam of radiant energy. Other methods are also known for forming latent electrostatic images such as, for example, providing a carrier with a dielectric surface and transferring a preformed electrostatic charge to the surface. After the latent image has been formed, it is developed by colored toner particles dispersed in a nonpolar liquid. The image may then be transferred to a receiver sheet.

Liquid developers can comprise a thermoplastic resin, colorant like pigment or dye, and a dispersant nonpolar liquid. The colored toner particles are dispersed in a nonpolar liquid which generally has a high volume resistivity in excess of $10^9$ ohm-centimeters, a low dielectric constant, for example below 3.0, and a high vapor pressure. Generally, the toner particles are less than 10 microns (μm) average by area size as measured by the Horiba Capa 500 or 700 particle sizers.

Since the formation of images depends, for example, on the difference of the charge between the toner particles in the liquid developer and the latent electrostatic image to be developed, it has been found desirable to add a charge director compound and charge adjuvants, which increase the magnitude of the charge, such as polyhydroxy compounds, amino alcohols, polybutylene succinimide compounds, aromatic hydrocarbons, metallic soaps, and the like to the liquid developer comprising the thermoplastic resin, the nonpolar liquid and the colorant.

U.S. Pat. No. 5,019,477, the disclosure of which is totally incorporated herein by reference, discloses a liquid electrostatic developer comprising a nonpolar liquid, thermoplastic resin particles, and a charge director. The ionic or zwitterionic charge directors may include both negative charge directors, such as lecithin, oil-soluble petroleum sulfonate and alkyl succinimide, and positive charge directors, such as cobalt and iron naphthanates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer of (iii) selected from the group consisting of vinyl toluene and styrene, and (iv) selected from the group consisting of butadiene and acrylate.

U.S. Pat. No. 5,030,535 discloses a liquid developer composition comprising a liquid vehicle, a charge control additive and toner particles. The toner particles may contain pigment particles and a resin selected from the group consisting of polyolefins, halogenated polyolefins and mixtures thereof. The liquid developers are prepared by first dissolving the polymer resin in a liquid vehicle by heating at temperatures of from about 80° C. to about 120° C., adding pigment to the hot polymer solution and attriting the mixture, and then cooling the mixture so that the polymer becomes insoluble in the liquid vehicle, thus forming an insoluble resin layer around the pigment particles, may be selected from known thermoplastics, including fluoropolymers.

Moreover, in U.S. Pat. No. 4,707,429 there are illustrated, for example, liquid developers with an aluminum stearate charge additive. Liquid developers with charge directors are also illustrated in U.S. Pat. No. 5,045,425.

In U.S. Pat. No. 5,306,591, there is disclosed a liquid developer comprised of thermoplastic resin particles, a charge director, and a charge adjuvant comprised of an imine bisquinone; and U.S. Pat. No. 5,308,731 discloses a liquid developer comprised of a liquid, thermoplastic resin particles, a nonpolar liquid soluble charge director, and a charge adjuvant comprised of a metal hydroxycarboxylic acid.

The disclosures of each of the U.S. Pat. Nos. mentioned herein are totally incorporated herein by reference.

In U.S. Pat. No. 5,407,775, the disclosure of which is totally incorporated herein by reference, there is illustrated a liquid developer comprised of a liquid, thermoplastic resin particles, a nonpolar liquid soluble charge director comprised of a zwitterionic quaternary ammonium block copolymer wherein both cationic and anionic sites contained therein are covalently bonded within the same polar repeat unit in the quaternary ammonium block copolymer.

In U.S. Pat. No. 5,459,007, the disclosure of which is totally incorporated herein by reference, there is illustrated a liquid developer comprised of a liquid, thermoplastic resin particles, a nonpolar liquid soluble charge director comprised of an ionic or zwitterionic quaternary ammonium block copolymer ammonium block copolymer, and wherein the number average molecular weight thereof of the charge director is from about 70,000 to about 200,000.

In U.S. Pat. No. 5,290,654, the disclosure of which is totally incorporated herein by reference, there is illustrated a process for the preparation of, for example, dry toners comprised of dispersing a polymer solution comprised of an organic solvent and a polyester, and homogenizing and heating the mixture to remove the solvent and thereby form toner composites. Additionally, there is illustrated in U.S. Pat. No. 5,278,02, the disclosure of which is totally incorporated herein by reference, a process for the preparation of a toner composition comprising:

(i) preparing a latex emulsion by agitating in water a mixture of a nonionic surfactant, an anionic surfactant, a first nonpolar olefinic monomer, a second nonpolar diolefinic monomer, a free radical initiator and a chain transfer agent;

(ii) polymerizing the latex emulsion mixture by heating from ambient temperature to about 80° C. to form nonpolar olefinic emulsion resin particles of volume average diameter of from about 5 nanometers to about 500 nanometers;

(iii) diluting the nonpolar olefinic emulsion resin particle mixture with water;

(iv) adding to the diluted resin particle mixture a colorant or pigment particles, and optionally dispersing the resulting mixture with a homogenizer;

(v) adding a cationic surfactant to flocculate the colorant or pigment particles to the surface of the emulsion resin particles;

(vi) homogenizing the flocculated mixture at high shear to form statically bound aggregated composite particles with a volume average diameter of less than or equal to about 5 microns;

(vii) heating the statically bound aggregate composite particles to form nonpolar toner sized particles;

(viii) halogenating the nonpolar toner sized particles to form nonpolar toner sized particles having a halopolymer resin outer surface or encapsulating shell; and (ix) isolating the nonpolar toner sized composite particles.

In U.S. Pat. No. 5,346,797, the disclosure of which is totally incorporated herein by reference, there is illustrated a process for the preparation of toner compositions comprising (i) preparing a pigment dispersion in water, which dispersion is comprised of a pigment, an ionic surfactant and optionally a charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin and charge control agent to form electrostatically bounded toner size aggregates; and (iii) heating the statically bound aggregated particles above the resin Tg to form said toner composition comprised of polymeric resin, pigment and optionally a charge control agent.

In U.S. Pat. No. 5,403,693, the disclosure of which is totally incorporated herein by reference, there is illustrated a process for the preparation of toner compositions with controlled particle size comprising:

(i) preparing a pigment dispersion in water, which dispersion is comprised of a pigment, an ionic surfactant in amounts of from about 0.5 to about 10 percent by weight of water, and an optional charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin and charge control agent;

(iii) stirring the resulting sheared viscous mixture of (ii) at from about 300 to about 1,000 revolutions per minute to form electrostatically bound substantially stable toner size aggregates with a narrow particle size distribution;

(iv) reducing the stirring speed in (iii) to from about 100 to about 600 revolutions per minute and subsequently adding further anionic or nonionic surfactant in the range of from about 0.1 to about 10 percent by weight of water to control, prevent, or minimize further growth or enlargement of the particles in the coalescence step (iii); and (v) heating and coalescing from about 5 to about 50° C. above about the resin glass transition temperature, Tg, which resin Tg is from between about 45 to about 90° C. and preferably from between about 50 and about 80° C., the statically bound aggregated particles to form said toner composition comprised of resin, pigment and optional charge control agent; and (vi) optionally washing the particles of step (v) with water to remove the surfactants followed by drying either by a freeze dryer or fluid bed drying.

SUMMARY OF THE INVENTION

It is an object of the present invention to provide toner and liquid developer processes with many of the advantages illustrated herein.

In another object of the present invention there are provided simple and economical chemical processes for the direct preparation of black and colored liquid toner compositions with, for example, excellent pigment dispersion.

In a further object of the present invention there is provided a process for the preparation of compositions with certain effective particle sizes by controlling the temperature of the aggregation which comprises stirring and heating about below the resin glass transition temperature (Tg).

Another object of the invention is to provide a negatively charged liquid developer wherein there is selected as charge directors ionic and/or zwitterionic ammonium AB diblock copolymers, and which copolymer has an important molecular weight distribution, which is bimodal, comprising an AB diblock component with a number average molecular weight (determined by dividing the number of moles of monoinitiator into the number of grams of acrylic monomer being initiated by the charged molar quantity of monoinitiator) is from about 70,000 to about 200,000, preferably from about 80,000 to about 150,000, and more preferably about 85,000 to 100,000, and a second AB diblock component with a number average molecular weight $M_n$ is from about 2,200 to about 6,000, preferably from about 3,000 to about 20,000, and more preferably about 4,000 to 10,000. Effective ratios of the high $M_n$ over the low $M_n$ components range from 99/1 to 10/90, with a preferred range of 95/5 to 50/50, wherein A is considered the polar ionic block like an ammonium containing segment, and B is considered the nonpolymer block like 2-ethylhexylmethacrylate. Examples of acceptable conductivity and mobility ranges for developers charged with the bimodal molecular weight distribution charge directors of this invention are illustrated herein. Conductivities measured at ambient temperature (21° C. to 23° C.) for developers containing one percent toner solids are considered high in the 10 to 20 pmhos/centimeter range and very high at greater than 20 pmhos/centimeter. Optimum conductivities are less than about 10 pmhos/centimeter and preferably less than about 5 pmhos/centimeter. As conductivities increase above the optimum range, excess ions can compete with toner particles of the same charge for development of the latent image giving rise to low developed mass resulting in low print density images. In addition to having an optimum conductivity of less than 10 pmhos/centimeters, the liquid toner or developer of this invention also possesses a mobility of at least $-1.5\times10_{-10}$ $m_2/Vs$ and preferably greater than $-2.5\times10^{-10}$ $m_2/Vs$ in embodiments.

It is still a further object of the invention to provide a liquid developer wherein developed image defects, such as smearing, loss of resolution and loss of density, are eliminated, or minimized.

It is another object of the invention to provide low conductivity liquid developers which will be effective in an image-on-image xerographic printing process where an image is developed on a latent image bearing member in the xerographic process, and then that image bearing member is passed through the xerographic charging, imagewise discharging, and development steps to develop a multilayered image. The subsequent development steps can be accomplished with liquid toner dispersions of colors different than the first or previous development resulting in a multicolored image which can be transferred from an imaging member to a substrate.

These and other objects of the present invention are accomplished in embodiments by the provision of liquid toners and processes thereof. In embodiments of the present invention, there are provided processes for the economical direct preparation of liquid toner compositions by improved flocculation or heterocoagulation, and coalescence, and wherein the temperature of aggregation can be utilized to control the final toner particle size, that is average volume diameter. In embodiments, the present invention is directed to a process for the preparation of liquid developers comprising:

(i) preparing a pigment dispersion, which dispersion is comprised of a pigment, and an ionic surfactant;

(ii) shearing said pigment dispersion with a latex or emulsion blend comprised of a nonionic surfactant, resin, and a counterionic surfactant with a charge polarity of opposite sign to that of said ionic surfactant and optionally adding further anionic, or nonionic surfactant to stabilize the aggregates obtained in (iii);

(iii) heating the above resulting sheared or aqueous blend below about, or about equal to, the glass transition temperature (Tg) of the resin to form toner size aggregates with a narrow particle size distribution;

(iv) heating said bound aggregates about equal to, or above about the Tg of the resin to form toner size particles in an aqueous medium, and which particles possess a narrow particle size distribution; and (v) separating from the aqueous medium toner particles of resin and pigment, and dispersing said toner particles in a carrier fluid.

In embodiments, the present invention is directed to processes for the preparation of liquid toner compositions which comprises initially attaining or generating an ionic pigment dislersion, for example dispersing an aqueous mixture of a pigment or pigments, such as carbon black like REGAL 330®, phthalocyanine, quinacridone or RHODAMINE B™ type with a cationic surfactant, such as benzalkonium chloride, by utilizing a high shearing device, such as a Brinkmann Polytron, thereafter shearing this mixture by utilizing a high shearing device, such as a Brinkmann Polytron, a sonicator or microfluidizer with a suspended resin mixture comprised of polymer components, such as poly(styrene butadiene) or poly(styrene butylacrylate); and wherein the particle size of the suspended resin mixture is, for example, from about 0.01 to about 0.5 micron in an aqueous surfactant mixture containing an anionic surfactant such as sodium dodecylbenzene sulfonate and nonionic surfactant; resulting in a flocculation, or heterocoagulation of the polymer or resin particles with the pigment particles caused by the neutralization of anionic surfactant absorbed on the resin particles with the oppositely charged cationic surfactant absorbed on the pigment particle; and further stirring the mixture using a mechanical stirrer at 250 to 500 rpm while heating below the resin Tg, for example from about 5 to about 15° C., and allowing the formation of electrostatically stabilized aggregates ranging from about 0.5 micron to about 10 microns; followed by heating above the resin Tg, for example from about 5 to about 50° C., to cause coalescence of the latex, pigment particles and optionally followed by washing with, for example, hot water to remove, for example, surfactant, and drying such as by use of an Aeromatic fluid bed dryer, freeze dryer, or spray dryer; whereby toner particles comprised of resin pigment, and optional charge control additive with various particle size diameters can be obtained, such as from about 1 to about 10 microns in average volume particle diameter and preferably as measured by the Coulter Counter, and wherein these toner particles are dispersed in a liquid to generate a liquid developer.

Embodiments of the present invention include a process for the preparation of liquid toner compositions comprised of resin and pigment comprising (i) preparing a pigment dispersion in a water, which dispersion is comprised of a pigment, an ionic surfactant, and optionally a charge control agent;

(ii) shearing the pigment dispersion with a latex mixture comprised of polymeric or resin particles in water and counterionic surfactant with a charge polarity of opposite sign to that of said ionic surfactant, and a nonionic surfactant;

(iii) heating the resulting homogenized mixture below about the resin Tg at a temperature of from about 35 to about 50° C. (or 5 to 20° C. below the resin Tg) thereby causing flocculation or heterocoagulation of the formed particles of pigment, resin and charge control agent to form electrostatically bounded toner size aggregates;

(iv) adding further anionic, or non ionic surfactant to stabilize the aggregates obtained in (iii), followed by reducing the stirring speeds to about 100 to 600 rpm; and (v) heating to, for example, from about 60 to about 95° C. the statically bound aggregated particles of (iv) to form a composition comprised of polymeric resin and pigment; optionally washing the formed product with water to remove the surfactant; drying and subsequently dispersing the formed product of solids of resin, pigment, and additive in a hydrocarbon fluid. The liquid developers may contain charge adjuvants, or charge additives, and charge directors.

The pigment dispersion can be obtained by a number of methods depending, for example, on the form of the pigment utilized. In some instances, pigments available in the wet cake form or concentrated form containing water can be easily dispersed utilizing a homogenizer or stirring. In other instances, pigments are available in a dry form, whereby dispersion in water is preferably effected by microfluidizing using, for example, a M-110 microfluidizer and passing the pigment dispersion from 1 to 10 times through the chamber of the microfluidizer, or by sonication, such as using a Branson 700 sonicator, with the optional addition of dispersing agents such as the aforementioned ionic or nonionic surfactants.

More specifically the process of the present invention comprises the following steps:

(i) preparing a pigment dispersion in water, which dispersion is comprised of a pigment, an ionic surfactant and optionally a charge control agent by mixing at high speeds of about 1,000 to about 3,000 rpms using a high shear device, such as a polytron, or by a microfluidizer, or by an ultrasonic probe;

(ii) shearing the pigment dispersion (i) with a latex mixture comprised of polymeric or resin particles in water and counterionic surfactant with a charge polarity of opposite sign to that of said ionic surfactant, and a nonionic surfactant at speeds of 2,000 to 15,000 rpm and preferably at speeds of 3,000 to 10,000 for a period of 1 to 30 minutes and preferably 2 to 15 minutes;

(iii) heating the resulting homogenized mixture below about the resin Tg at a temperature of from about 35 to about 50° C. (or 5 to 20° C. below the resin Tg) thereby causing flocculation or heterocoagulation of the formed particles of pigment, resin and charge control agent to form toner size aggregates of 2 to 20 microns and preferably in the range of 3 to 10 microns with a GSD in the range of 1.16 to 1.30 and preferably in the range of 1.16 to 1.25; and (iv) adding further anionic, or nonionic surfactant to stabilize the aggregates obtained in (iii), followed by reducing the stirring speeds to about 50 to 600 rpm and preferably in the range of 100 to 300 rpm;

(v) heating to, for example, from about 60 to about 95° C. the statically bound aggregated particles of (iv) to form a composition comprised of polymeric resin and pigment; followed by optionally washing the formed product with water to remove the surfactant; followed by drying followed by dispersing the formed product in a hydrocarbon fluid. The liquid developers may contain charge adjuvants, or charge additives, and charge directors.

A number of known charge directors can be selected for the liquid toners, such as for example zwitterionic diblock copolymer charge directors of poly(2-ethylhexyl methacrylate-co-N,N-dimethyl-N-methylenecarboxylate-N-ammoniumethyl methacrylate), poly(2-ethylhexyl methacrylate-co-N,N-dimethyl-N-propylenesulfonate-N-ammoniumethyl methacrylate), poly(2-ethylhexyl methacrylate-co-N,N-dimethyl-N-propylenephosphonate-N-ammoniumethyl methacrylate), poly(2-ethylhexy methacrylate-co-N,N-dimethyl-N-propylenephosphinate-N-ammoniumethyl methacrylate), poly(2-ethyihexyl methacrylate-co-N,N-dimethyl-N-propylenesulfinate-N-ammoniumethyl methacrylate), poly(2-ethyihexyl methacrylate-co-N,N-diethyl-N-methylenecarboxylate-N-ammoniumethyl methacrylate), poly(2-ethylhexyl methacrylate-co-N,N-diethyl-N-propylenesulfonate-N-ammoniumethyl methacrylate), poly(2-ethylhexyl methacrylate-co-N,N-dimethyl-N-butylenephosphonate-N-ammoniumethyl methacrylate), poly(2-ethylhexyl methacrylate-co-N,N-dimethyl-N-decamethylenephosphonate-N-ammoniumethyl methacrylate), poly(2-ethylhexyl methacrylate-co-N,N-dimethyl-N-decamethylenephosphinate-N-ammoniumethyl methacrylate), poly(2-ethylhexyl methacrylate-co-N,N-dimethyl-N-butylenecarboxylate-N-ammoniumethyl methacrylate), poly(2-ethylhexyl methacrylate-co-N,N-dimethyl-N-ethyleneoxyethylenecarboxylate-N-ammoniumethyl methacrylate), poly(2-ethylhexyl methacrylate-co-N,N-dimethyl-N-ethyleneoxyethylenesulfonate-N-ammoniumethyl methacrylate), poly(2-ethylhxyl methacrylate-co-N,N-dimethyl-N-ethyleneoxyethylenephosphonate-N-ammoniumethyl methacrylate), poly(N,N-dibutylmethacrylamido-co-N,N-dimethyl-N-methylenecarboxylate-N-ammoniumethyl methacrylate), poly(N,N-dibutylmethacrylamido-co-N,N-dimethyl-N-propylenesulfonate-N-ammoniumethyl methacrylate) and the like.

The charge director can be selected for the liquid developers in various effective amounts, such as for example from about 0.5 percent to 100 percent by weight relative to developer solids and preferably 1 percent to 20 percent by weight relative to developer solids. Developer solids includes toner resin, pigment, and optional charge adjuvant. Without pigment, the developer may be selected for the generation of a resist, or a printing plate. Effective ratios of the high $M_n$ over the low $M_n$ components ranges from 99/1 to 10/90, with a preferred range of 95/5 to 50/50.

Examples of liquid carriers or vehicles selected for the liquid developers of the present invention include a liquid with viscosity of from about 0.5 to about 500 centipoise, and preferably from about 1 to about 20 centipoise, and a resistivity greater than or equal to $5\times10^9$ ohm/centimeters, such as $10^{13}$ ohm/centimeter, or more. Preferably, the liquid selected in embodiments is a branched chain aliphatic hydrocarbon. A nonpolar liquid of the ISOPAR® series available from the Exxon Corporation may also be used for the developers of the present invention. These hydrocarbon liquids are considered narrow portions of isoparaffinic hydrocarbon fractions with extremely high levels of purity. For example, the boiling range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is between about 254.4° C. and about 329.4° C. ISOPAR L® has a mid-boiling point of approximately 194° C. ISOPAR M® has an auto ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR M® has a flash point of 80° C. as determined by the ASTM D-56 method. The liquids selected are known and should have an electrical volume resistivity in excess of $10^9$ ohm-centimeters and a dielectric constant below or equal to 3.0. Moreover, the vapor pressure at 25° C. should be less than or equal to 10 Torr in embodiments.

While the ISOPAR® series liquids are the preferred nonpolar liquids in embodiments for use as dispersants in the liquid developers of the present invention, the important characteristics of viscosity and resistivity can be achieved, it is believed, with other suitable liquids. Specifically, the NORPAR® series available from Exxon Corporation, the SOLTROL® series available from the Phillips Petroleum Company, and the SHELLSOL® series available from the Shell Oil Company can be selected. Other useful liquids include mineral oils such as the SUPURLA® series available from the Amoco Oil Company.

The amount of the liquid employed in the developer of the present invention is from about 90 to about 99.9 percent, and preferably from about 95 to about 99 percent by weight of the total developer dispersion. The total solids content of the developers is, for example, 0.1 to 10 percent by weight, preferably 0.3 to 3 percent, and more preferably 0.5 to 2.0 percent by weight.

Various suitable thermoplastic toner resins can be selected for the liquid developers of the present invention in effective amounts of, for example, in the range of 99 percent to 40 percent of developer solids, and preferably 95 percent to 70 percent of developer solids; developer solids includes the thermoplastic resin, optional pigment and charge control agent and any other component that comprises the particles. Examples of such resins include ethylene vinyl acetate (EVA) copolymers (ELVAX® resins, E. I. DuPont de Nemours and Company, Wilmington, Del.); copolymers of ethylene and an α-β-ethylenically unsaturated acid selected from the group consisting of acrylic acid and methacrylic acid; copolymers of ethylene (80 to 99.9 percent), acrylic or methacrylic acid (20 to 0.1 percent)/alkyl ($C_1$ to $C_5$) ester of methacrylic or acrylic acid (0.1 to 20 percent); polyethylene; polystyrene; isotactic polypropylene (crystalline); ethylene ethyl acrylate series sold under the trademark BAKELITE® DPD 6169, DPDA 6182 Natural (Union Carbide Corporation); ethylene vinyl acetate resins, for example DQDA 6832 Natural 7 (Union Carbide Corporation); SURLYN® ionomer resin (E. I. DuPont de Nemours and Company); or blends thereof; polyesters; polyvinyl toluene; polyamides; styrene/butadiene copolymers; epoxy resins; acrylic resins, such as a copolymer of acrylic or methacrylic acid; and at least one alkyl ester of acrylic or methacrylic acid wherein alkyl is from 1 to about 20 carbon atoms like methyl methacrylate (50 to 90 percent)/methacrylic acid (0 to 20 percent)/ethylhexyl acrylate (10 to 50 percent); and other acrylic resins including ELVACITE® acrylic resins (E. I. DuPont de Nemours and Company); or blends thereof. Preferred copolymers are the copolymer of ethylene and an α-β-ethylenicaily unsaturated acid of either acrylic acid or methacrylic acid. In a preferred embodiment, NUCREL® like NUCREL® 599, NUCREL® 699, or NUCREL® 960 can be selected as the thermoplastic resin.

The liquid developer of the present invention may optionally contain a colorant dispersed in the resin particles. Colorants, such as pigments or dyes and mixtures thereof, are preferably present to render the latent image visible.

The colorant may be present in the resin particles in an effective amount of, for example, from about 0.1 to about 60 percent, and preferably from about 1 to about 30 percent by weight based on the total weight of solids contained in the developer. The amount of colorant used may vary depending on the use of the developer. Examples of colorants include pigments like carbon blacks like REGAL 330®, cyan, magenta, yellow, blue, green, brown and mixtures thereof; pigments as illustrated in U.S. Pat. No. 5,223,368, the disclosure of which is totally incorporated herein by reference.

To increase the toner particle charge and, accordingly, increase the mobility and transfer latitude of the toner particles, charge adjuvants can be added to the toner. For example, adjuvants, such as metallic soaps like aluminum or magnesium stearate or octoate, fine particle size oxides, such as oxides of silica, alumina, titania, and the like, paratoluene sulfonic acid, and polyphosphoric acid may be added. Negative charge adjuvants increase the negative charge of the toner particle, while the positive charge adjuvants increase the positive charge of the toner particles. With the invention of the present application, the adjuvants or charge additives can be comprised of the metal catechol and aluminum hydroxyacid complexes illustrated in U.S. Pat. Nos. 5,306,591 and 5,308,731, the disclosures of which are totally incorporated herein by reference, and which additives in combination with the charge directors of the present invention have the following advantages over the aforementioned prior art charge additives: improved toner charging characteristics, namely an increase in particle charge, as measured by ESA mobility, from −1.4 E-10 $m_2$/Vs to −2.3 E-10 $m_2$/Vs, that results in improved image development and transfer, from 80 percent to 93 percent, to allow improved solid area coverage, from transferred image reflectance density of 1.2 to 1.3. The adjuvants can be added to the toner particles in an amount of from about 0.1 percent to about 15 percent of the total developer solids and preferably from about 1 percent to about 5 percent of the total weight of solids contained in the developer. Other charge adjuvants can be selected, such as those illustrated in copending patent application, especially ALHOS, U.S. Pat. No. 5,366,840, the disclosure of which is totally incorporated herein by reference. More specifically, there is illustrated in this patent a liquid developer comprised of thermoplastic resin particles, an optional charge director, and a charge additive or adjuvant comprised of a component of the formulas

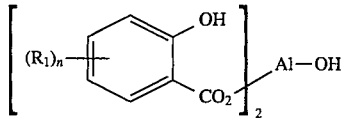

or

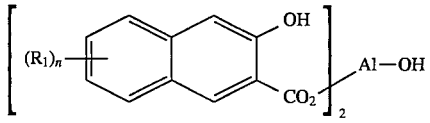

wherein $R_1$ is selected from the group consisting of hydrogen and alkyl, and n is 0 (zero), 1, 2, 3 or 4.

The charge on the toner particles alone may be measured in terms of particle mobility using a high field measurement device. Particle mobility is a measure of the velocity of a toner particle in a liquid developer divided by the size of the electric field within which the liquid developer is employed. The greater the charge on a toner particle, the faster it moves through the electrical field of the development zone. The movement of the particle is required for image development and background cleaning.

Illustrative examples of specific resin particles, resins or polymers selected for the process of the present invention are as indicated herein, and include known polymers such as poly(styrene-butadiene), poly(paramethyl styrene-butadiene), poly(meta-methyl styrene-butadiene), poly(alpha-methyl styrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(meta-methyl styrene-isoprene), poly(alpha-methylstyrene-isoprene), poly-(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene); polymers such as poly(styrene-butadiene-acrylic acid), poly(styrene-butadiene-methacrylic acid), PLIOTONE™ available from Goodyear, polyethylene-terephthalate, polypropyleneterephthalate, polybutylene-terephthalate, polypentylene-terephthalate, polyhexalene-terephthalate, polyheptadene-terephthalate, polyoctaleneterephthalate, POLYLITE™ (Reichhold Chemical Inc), PLASTHALL™ (Rohm & Hass), CYGAL™ (American Cyanamide), ARMCO™ (Armco Composites), CELANEX™ (Celanese Eng), RYNITE™ (DuPont), STYPOL™, and the like. The resin selected, which generally can be in embodiments styrene acrylates, styrene butadienes, styrene methacrylates, or polyesters, are present in various effective amounts, such as from about 85 weight percent to about 98 weight percent of the toner, and can be of small average particle size, such as from about 0.01 micron to about 1 micron in average volume diameter as measured by the Brookhaven nanosize particle analyzer. Other sizes and effective amounts of resin particles may be selected in embodiments, for example copolymers of poly(styrene butylacrylate acrylic acid) or poly(styrene butadiene acrylic acid).

The resin selected for the process of the present invention is preferably prepared from emulsion polymerization methods, and the monomers utilized in such processes include styrene, acrylates, methacrylates, butadiene, isoprene, and optionally acid or basic olefinic monomers, such as acrylic acid, methacrylic acid, acrylamide, methacrylamide, quaternary ammonium halide of dialkyl or trialkyl acrylamides or methacrylamide, vinylpyridine, vinylpyrrolidone, vinyl-N-methylpyridinium chloride, and the like. The presence of acid or basic groups is optional and such groups can be present in various amounts of from about 0.1 to about 10 percent by weight of the polymer resin. Known chain transfer agents, for example dodecanethiol, about 1 to about 10 percent, or carbon tetrabromide in effective amounts, such as from about 1 to about 10 percent, can also be selected when preparing the resin particles by emulsion polymerization. Other processes for obtaining resin particles of from, for example, about 0.01 micron to about 3 microns can be selected from polymer microsuspension process, such as disclosed in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding processes, or other known processes.

Various known colorants or pigments present in the toner in an effective amount of, for example, from about 1 to about 25 percent by weight of the toner, and preferably in an amount of from about 1 to about 15 weight percent, that can be selected include carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1 ™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E. I. DuPont de Nemours & Company, SUNSPERSE™ of FLEXVERSE™ from Sun Chemicals and the like. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra(octadecyl sulfonamido) phthalocyanine, x-copper phthalocyanine pigment listed in the Color Index as Cl 74160,Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention. The pigments selected are present in various effective amounts, such as from about 1 weight percent to about 65 weight and preferably from about 2 to about 12 percent, of the toner.

The toner may also include known charge additives in effective amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like aluminum complexes, and the like.

Surfactants in amounts of, for example, 0.1 to about 25 weight percent in embodiments include, for example, nonionic surfactants such as diaikylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the nonionic surfactant is in embodiments, for example from about 0.01 to about 10 percent by weight, and preferably from about 0.1 to about 5 percent by weight of monomers, used to prepare the copolymer resin.

Examples of ionic surfactants include anionic and cationic with examples of anionic surfactants being, for example, sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. An effective concentration of the anionic surfactant generally employed is, for example, from about 0.01 to about 10 percent by weight, and preferably from about 0.1 to about 5 percent by weight of monomers used to prepare the copolymer resin particles of the emulsion or latex blend.

Examples of the cationic surfactants, which are usually positively charged, selected for the toners and processes of the present invention include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, and mixtures thereof. This surfactant is utilized in various effective amounts, such as for example from about 0.1 percent to about 5 percent by weight of water. Preferably, the molar ratio of the cationic surfactant used for flocculation to the anionic surfactant used in the latex preparation is in the range of from about 0.5 to 4, and preferably from 0.5 to 2.

Counterionic surfactants are comprised of either anionic or cationic surfactants as illustrated herein and in the amount indicated, thus, when the ionic surfactant of step (i) is an anionic surfactant, the counterionic surfactant is a cationic surfactant.

Examples of the surfactant, which are added to the aggregated particles to "freeze" or retain particle size, and GSD achieved in the aggregation can be selected from the anionic surfactants such as sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. They can also be selected from nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the anionic or nonionic surfactant generally employed as a "freezing agent" or stabilizing agent is, for example, from about 0.01 to about 10 percent by weight, and preferably from about 0.5 to about 5 percent by weight of the total weight of the aggregates comprised of resin latex, pigment particles, water, ionic and nonionic surfactants mixture.

Surface additives that can be added to the toner compositions after washing or drying include, for example, metal salts, metal salts of fatty acids, colloidal silicas, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa in amounts of from 0.1 to 2 percent which can be added during the aggregation process or blended into the formed toner product.

Imaging methods are also envisioned with the toners of the present invention, reference for example a number of the patents mentioned herein, and U.S. Pat. No. 4,265,660, the disclosure of which is totally incorporated herein by reference. Methods of imaging encompassed by the present invention include specifically after formation of a latent image on a photoconductive imaging member, reference U.S. Pat. No. 5,306,591, the disclosure of which is totally incorporated herein by reference, the image is developed with the liquid toner illustrated herein by, for example, immersion of the photoconductor therein, followed by transfer and fixing of the image.

The following Examples are being submitted to further define various species of the present invention. These Examples are intended to be illustrative only and are not intended to limit the scope of the present invention. Also, parts and percentages are by weight unless otherwise indicated.

EXAMPLE I

Emulsion Synthesis of Styrene-Butylacrylate-Acrylic Acid-(Latex A):

A polymeric or emulsion latex was prepared by the emulsion polymerization of styrene/butylacrylate/acrylic acid (88/12/2 parts)in a nonionic/anionic surfactant solution (3 percent) as follows. 352 Grams of styrene, 48 grams of butyl acrylate, 8 grams of acrylic acid, and 12 grams (3 percent) of dodecanethiol were mixed with 600 milliliters of deionized water in which 9 grams of sodium dodecyl benzene sulfonate anionic surfactant (NEOGEN R™ which contains 60 percent of active component), 8.6 grams of polyoxyethylene nonyl phenyl ether—nonionic surfactant (ANTAROX 897™—70 percent active), and 4 grams of ammonium persulfate initiator were dissolved. The emulsion was then polymerized at 70° C. for 6 hours. The resulting latex, 60 percent water and 40 percent (weight percent throughout) solids, was comprised of a copolymer of polystyrene/polybutyl acrylate/polyacrylic acid, 88/1 2/2; the Tg of the latex dry sample was 54° C., as measured on a DuPont DSC; $M_w$=23,500, and $M_n$ =5,000 as determined on Hewlett Packard GPC. The zeta potential as measured on Pen Kem Inc. Laser Zee Meter was −90 millivolts for this polymeric latex. The particle size of the latex as measured on Brookhaven BI-90 Particle Nanosizer was 150 nanometers.

PREPARATION OF CYAN PARTICLES:

30 Grams of BHD 6000 (53 percent Solids) SUNSPERSE BLUE™ pigment were dispersed in 240 milliliters of deionized water containing 2.3 grams of alkylbenzyldimethyl ammonium chloride cationic surfactant (SANIZOL B™) by stirring. This cationic dispersion of the pigment was then simultaneously added with 260 grams of the above prepared Latex A (40 percent solids) containing 2.3 grams of anionic surfactant to 300 grams of water while being homogenized with an IKA G45M probe for 3 minutes at 7,000 rpm. This mixture then was transferred into a reaction kettle and stirred using an ordinary stirrer for a period of 30 minutes while the temperature was raised from room temperature to 40° C. to perform the aggregation. A sample thereafter taken was measured on the Coulter Counter indicating particles of about 2.5 microns with a GSD of 1.22 had been formed. 60 Milliliters of 20 percent (W/W) of anionic surfactant solution were added to the reactor prior to raising the reactor temperature to 90° C. to perform the coalescence. The temperature was maintained for a period of 4 hours, followed by cooling of the reactor contents. The particle size was measured and no change in the size or GSD was noted. The particles were filtered and washed with deionized water to remove surfactant, followed by drying on a freeze dryer.

These dry particles were then redispersed along with the charge director comprised of poly(2-ethylhexyl methacrylate-co-N,N-dimethyl-N-methylenecarboxylate-N-ammoniummethyl methacrylate in the hydrocarbon ISOPAR L™, 91 percent, to enable a liquid Ink developer.

PREPARATION OF MAGENTA PARTICLES:

50 Grams of QHD 6040 (39 percent Solids) SUNSPERSE Red™ pigment were dispersed in 240 milliliters of deionized water containing 2.6 grams of alkylbenzyldimethyl ammonium chloride cationic surfactant (SANIZOL B™) by stirring. This cationic dispersion of the pigment was then simultaneously added with 260 grams of the above prepared Latex A (40 percent solids) containing 2.3 grams of anionic surfactant to 300 grams of water while being homogenized with an IKA G45M probe for 3 minutes at 7,000 rpm. This mixture was then transferred into a reaction kettle and stirred using an ordinary stirrer for a period of 45 minutes while the temperature was raised from room temperature to 40° C. to perform the aggregation. A sample thereof was measured on the Coulter Counter indicating particles of about 2.9 microns with a GSD of 1.21 had been formed. 65 Milliliters of 20 percent (WAN) of anionic surfactant solution were added to the reactor prior to raising the reactor temperature to 90° C. to perform the coalescence. The temperature was held there for a period of 4 hours, followed by cooling of the reactor content. The measured particle size was 3.0 microns with a GSD of 1.22. Particles were filtered and washed with deionized water to remove the surfactant, followed by drying on a freeze dryer. These dry particles were then redispersed along with the charge director comprised of poly(2-ethylhexyl methacrylate-co-N,N-dimethyl-N-methylenecarboxylate-N-ammoniummethyl methacrylate in the hydrocarbon ISOPAR L™ to enable a magenta liquid ink developer.

PREPARATION OF YELLOW PARTICLES:

60 Grams of YHD 9439 (33 percent Solids) SUNSPERSE Yellow™ pigment were dispersed in 240 milliliters of deionized water containing 3.0 grams of alkylbenzyldimethyl ammonium chloride cationic surfactant (SANIZOL B™) by stirring. This cationic dispersion of the pigment was then simultaneously added with 260 grams of the above prepared Latex A (40 percent solids) containing 2.3 grams of anionic surfactant to 350 grams of water while being homogenized with an IKA G45M probe for 3 minutes at 7,000 rpm. This mixture was then transferred into a reaction kettle and stirred using an ordinary stirrer for a period of 45 minutes while the temperature was raised from room temperature to 45° C. to perform the aggregation. A sample thereafter taken was measured on the Coulter Counter indicating particles of about 3.2 microns with a GSD of 1.23 had been formed. 65 Milliliters of 20 percent (W/W) of anionic surfactant solution were added to the reactor prior to raising the reactor temperature to 90° C. to perform the coalescence. The temperature was retained for a period of 4 hours, followed by cooling of the reactor content. The measured particle size indicated a particle size of 3.3 microns and a GSD of 1.22. The particles were filtered and washed with deionized water to remove surfactants, followed by drying on a freeze dryer. The resulting dry toner particles were then redispersed together with the charge director comprised of poly(2-ethylhexyl methacrylate-co-N,N-dimethyl-N-methylenecarboxylate-N-ammoniummethyl methacrylate in the hydrocarbon ISOPAR L™ to enable a magenta liquid ink developer.

PREPARATION OF BLACK PARTICLES:

40 Grams of LHD 9409 (49 percent Solids) SUNSPERSE™ black pigment were dispersed in 240 milliliters of deionized water containing 2.3 grams of alkylbenzyldimethyl ammonium chloride cationic surfactant (SANIZOL B™) by stirring. This cationic dispersion of the pigment was then simultaneously added with 260 grams of the above prepared Latex A (40 percent solids) containing 2.3 grams of anionic surfactant to 300 grams of water while being homogenized with an IKA G45M probe for 3 minutes at 7,000 rpm. This mixture was then transferred into a reaction kettle and stirred using an ordinary stirrer for a period of 60 minutes while the temperature was raised from room temperature to 45° C. to perform the aggregation. A sample thereafter taken was measured on the Coulter Counter indicating particles of about 2.8 microns with a GSD of 1.24 had been formed. 50 Milliliters of 20 percent (W/W) of anionic surfactant solution were added to the reactor prior to raising the reactor temperature to 90° C. to perform the coalescence. The temperature was retained for a period of 4 hours, followed by cooling of the reactor content. The measured particle size was 3.0 microns and the GSD was 1.25. Particles were filtered and washed with deionized water to remove surfactant, followed by drying on freeze dryer. The resulting dry toner particles were then redispersed together with the charge director poly(2-ethylhexyl methacrylate-co-N,N-dimethyl-N-methylenecarboxylate-N-ammoniummethyl methacrylate in the hydrocarbon ISOPAR R™ to generate a magenta liquid ink developer.

Other modifications of the present invention may occur to those skilled in the art subsequent to a review of the present application and these modifications, including equivalents thereof, are intended to be included within the scope of the present invention.

What is claimed is:

1. A process for the preparation of liquid developers consisting essentially of (i) preparing a pigment dispersion, which dispersion is comprised of a pigment, and an ionic surfactant;

(ii) shearing said pigment dispersion with a latex or emulsion blend comprised of a nonionic surfactant, resin, and a counterionic surfactant with a charge polarity of opposite sign to that of said ionic surfactant and adding further anionic, or nonionic surfactant to stabilize the aggregates obtained in (iii);

(iii) heating the above resulting sheared aqueous blend below about the glass transition temperature (Tg) of the resin to form toner size aggregates with a narrow particle size distribution, and wherein during heating further stirring of said resulting sheared acqueous blend is accomplished and wherein said stirring is at a speed of from about 250 to about 500 revolutions per minute;

(iv) heating said bound aggregates above about the Tg of the resin to form toner size particles in an aqueous medium and which particles possess a narrow particle size distribution; and (v) separating from the aqueous medium toner particles of resin and pigment, and dispersing said toner particles in a nonpolar carrier fluid, and thereafter adding to the resulting mixture a charge adjuvant and a charge director.

2. A process in accordance with claim 1 wherein the temperature below the resin Tg of (iii) controls the size of the aggregated particles in the range of from about 2.5 to about 10 microns in average volume diameter.

3. A process in accordance with claim 1 wherein the size of said aggregates can be increased to from about 1.5 to about 10 microns by increasing the temperature of heating in (iii) to from about room temperature to about 50° C.

4. A process in accordance with claim 1 wherein the developer product of (v) with the carrier fluid contains a charge adjuvant or charge control agent, and a charge director.

5. A process in accordance with claim 4 wherein the charge adjuvant is aluminum stearate.

6. A process in accordance with claim 1 wherein the surfactant utilized in preparing the pigment dispersion is a cationic surfactant, and the counterionic surfactant present in the latex mixture is an anionic surfactant.

7. A process in accordance with claim 1 wherein the surfactant utilized in preparing the pigment dispersion is an anionic surfactant, and the counterionic surfactant present in the latex mixture is a cationic surfactant.

8. A process in accordance with claim 1 wherein the dispersion of (i) is accomplished by homogenizing at from about 1,000 revolutions per minute to about 10,000 revolutions per minute, at a temperature of from about 25° C. to about 35° C., and for a duration of from about 1 minute to about 120 minutes.

9. A process in accordance with claim 1 wherein the heating of the blend of latex, pigment, and surfactants in (iii) is accomplished at temperatures of from about 20° C. to about 5° C. below the Tg of the resin for a duration of from about 0.5 hour to about 6 hours.

10. A process in accordance with claim 1 wherein the resin is selected from the group consisting of poly(styrene-butadiene), poly(paramethyl styrene-butadiene), poly(meta-methylstyrene-butadiene), poly(alpha-methylstyrene-butadiene), poly(methylmethacrylatebutadiene), poly(ethylmethacrylate-butadiene), poly(propylmethacrylatebutadiene), poly(butylmethacrylate-butadiene), poly(methylacrylatebutadiene), poly(ethylacrylate-butadiene), poly(propylacrylate-butadiene), poly(butylacrylate-butadiene), poly(styrene-isoprene), poly(para-methyl styrene-isoprene), poly(meta-methylstyrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene); and the carrier fluid is an aliphatic hydrocarbon.

11. A process in accordance with claim 1 wherein the resin is selected from the group consisting of poly(styrene-butadiene-acrylic acid) poly(styrene-butadiene-methacrylic acid), poly(styrene-butylmethacrylate-acrylic acid), poly(styrene-butylacrylate-acrylic acid), polyethylene-terephthalate, polypropylene-terephthalate, polybutylene-terephthalate, polypentylene-terephthalate, polyhexalene-terephthalate, polyheptadene-terephthalate, polystyrene-butadiene, and polyoctalene-terephthalate.

12. A process in accordance with claim 1 wherein the nonionic surfactant is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol.

13. A process in accordance with claim 1 wherein the anionic surfactant is selected from the group consisting of sodium dodecyl sulfate, branched sodium dodecylbenzene sulfate, linear sodium dodecylbenzene sulfate, and sodium dodecylnaphthalene sulfate.

14. A process in accordance with claim 2 wherein the cationic surfactant is a quaternary ammonium salt.

15. A process in accordance with claim 1 wherein the pigment is carbon black, magnetite, cyan, yellow, magenta, or mixtures thereof.

16. A process in accordance with claim 1 wherein the carrier fluid is a liquid comprised of an aliphatic hydrocarbon.

17. A process in accordance with claim 1 wherein the carrier fluid is a liquid comprised of an aliphatic hydrocarbon comprised of a mixture of branched hydrocarbons with from about 12 to about 16 carbon atoms.

18. A process in accordance with claim 1 wherein the carrier fluid is a liquid comprised of an aliphatic hydrocarbon comprised of a mixture of normal hydrocarbons with from about 12 to about 16 carbon atoms.

19. A process in accordance with claim 1 wherein the nonionic surfactant concentration is from about 0.1 to about 5 weight percent; the anionic surfactant concentration is about 0.1 to about 5 weight percent; and the cationic surfactant concentration is about 0.1 to about 5 weight percent of the toner components of resin, and pigment.

20. A process in accordance with claim 1 wherein heating in (iii) is from about 5° C. to about 25° C. below the resin Tg.

21. A process in accordance with claim 1 wherein heating in (iii) is accomplished at a temperature of from about 25 to about 60° C.

22. A process in accordance with claim 1 wherein the resin Tg in (iii) is from about 50° to about 80° C.

23. A process in accordance with claim 1 wherein heating in (iv) is from about 5° to about 60° C. above the Tg.

24. A process in accordance with claim 1 wherein subsequent to (iii) there is added further anionic, or nonionic surfactant to stabilize the aggregates obtained in (iii).

25. A process for the preparation of liquid toner compositors comprised of solid components of resin, charge adjuvant, and pigment consisting of:

(i) preparing a pigment dispersion in water, which dispersion consists of pigment, ionic surfactant and a charge adjuvant;

(ii) shearing the pigment dispersion with a latex mixture consisting of polymer, or resin particles in water and counterionic surfactant with a charge polarity of opposite sign to that of said ionic surfactant, an a nonionic surfactant;

(iii) heating the resulting homogenized mixture at a temperature of from about 35° to about 50° C., thereby causing flocculation or heterocoagulation of the formed particles of pigment, resin and charge adjuvant to form electrostatically bounded toner size aggregates while being stirred at speeds of about 600 to 1,000 revolutions per minute;

(iv) reducing the stirring speed of (iii) to 100 to 600 revolutions per minute, followed by adding further anionic, or nonionic surfactant to stabilize the size of the aggregates; and (v) heating to from about 60° to about 95° C. the electrostatically bound aggregated particles to form a composition consisting of particles of resin, charge adjuvant, and pigment; optionally washing the formed composition with water to remove surfactants; drying and subsequently dispersing the formed composition of resin, pigment, and charge adjuvant in a hydrocarbon fluid, and subsequently adding thereto a charge adjuvant and a charge director.

26. A process in accordance with claim 25 wherein in (iv) the amount of surfactant added is from about 0.2 to about 20 percent by weight of water.

27. A process for the preparation of liquid toner compositors consisting of preparing a (i) pigment dispersion in water, which dispersion is comprised of a pigment, an ionic surfactant and charge adjuvant or charge control agent by mixing said components at high speeds of from 1,000 to about 3,000 revolutions per minute with a high shear device;

(ii) shearing the pigment dispersion (i) with a latex mixture consisting of polymeric or resin particles in water and counterionic surfactant with a charge polarity of opposite sign to that of said ionic surfactant and a nonionic surfactant, and which shearing is accomplished at speeds of from about 2,000 to about 15,000 revolutions per minute;

(iii) heating the resulting homogenized mixture below about the resin Tg and at a temperature of from about 35° to about 50° C. thereby causing flocculation or heterocoagulation of the formed particles of pigment, resin and charge adjuvant to form electrostatically bounded toner size aggregates of from about 2 to about 20 microns in average volume diameter;

(iv) adding further anionic, or nonionic surfactant in an amount of from about 0.2 to about 20 percent by weight of water to stabilize the aggregates obtained in (iii) followed by reducing the stirring speeds to from about 50 to 600 revolutions per minute; and (v) heating to from about 60° to about 95° C. the electrostatically bound aggregated particles of (iv) to form a composition consisting of particles of polymer or resin, charge adjuvant or charge control agent and pigment; followed by washing the formed composition with water to remove surfactants; drying; and dispersing the formed composition of polymer or resin, pigment, and charge adjuvant or charge control agent in a hydrocarbon fluid, and subsequently adding thereto a charge adjuvant and a charge director.

28. A process in accordance with claim 27 wherein in (iv) further anionic, or nonionic surfactant in an amount of from about 0.5 to 10 percent by weight is added to stabilize the aggregates obtained in (iii).

* * * * *